US012460411B2

(12) United States Patent
Wilcox

(10) Patent No.: US 12,460,411 B2
(45) Date of Patent: Nov. 4, 2025

(54) PRE-GLAZED WINDOW WALL SYSTEM

(71) Applicant: Arconic Technologies LLC, Pittburgh, PA (US)

(72) Inventor: Leonard Wilcox, Suwanee, GA (US)

(73) Assignee: Arconic Technologies LLC, Pittsburgh, PA (US)

( * ) Notice: Subject to any disclaimer, the term of this patent is extended or adjusted under 35 U.S.C. 154(b) by 403 days.

(21) Appl. No.: 18/047,367

(22) Filed: Oct. 18, 2022

(65) Prior Publication Data

US 2023/0160202 A1 May 25, 2023

Related U.S. Application Data

(60) Provisional application No. 63/281,789, filed on Nov. 22, 2021.

(51) Int. Cl.
*E04B 2/96* (2006.01)

(52) U.S. Cl.
CPC ..... *E04B 2/967* (2013.01)

(58) Field of Classification Search
CPC ..... E04B 2/967; E04B 2/90
See application file for complete search history.

(56) References Cited

U.S. PATENT DOCUMENTS 2,863,180 A * 12/1958 Birdwell ..... E06B 3/60 52/209
2,869,691 A * 1/1959 Evans ..... E06B 1/366 49/142
2,882,561 A 4/1959 Shrode
3,389,527 A 6/1968 Collard
3,802,127 A * 4/1974 Silvernail ..... E06B 1/38 49/504
5,666,773 A * 9/1997 Librande ..... B29C 66/73921 160/369
5,682,714 A 11/1997 Ishikuro et al.
5,937,597 A 8/1999 Sono
6,014,846 A 1/2000 Sono et al.
6,293,049 B1 * 9/2001 Shaw ..... E06B 3/5063 49/183
6,578,340 B2 6/2003 Ishikawa et al.
7,827,746 B2 11/2010 Speck
8,302,354 B2 * 11/2012 Quesada ..... E06B 1/003 52/204.5
9,175,471 B2 11/2015 Ting
9,574,831 B2 * 2/2017 Benes ..... E06B 3/26
9,725,946 B1 * 8/2017 Vassilev ..... E06B 1/34
(Continued)

*Primary Examiner* — Joshua K Ihezie
(74) *Attorney, Agent, or Firm* — Vorys, Sater, Seymour and Pease LLP

(57) ABSTRACT

A window wall system includes a sill receptor secured to an upper surface of a first floor slab, the sill receptor providing a base and an upright member extending from the base, a head receptor secured to a bottom surface of a second floor slab vertically offset from the first floor slab, and a glazing unit providing a sill, a head, and one or more panels extending between the sill and the head. A first hook defined by the sill is engageable with the upright member. When the upright member is received by the hook, the glazing unit is pivotable about the upright member toward a vertical orientation. A second hook is defined by the sill and receivable within a groove defined in the sill receptor when the glazing unit reaches the vertical orientation.

16 Claims, 4 Drawing Sheets

(56) References Cited

U.S. PATENT DOCUMENTS

| | | | | |
|---|---|---|---|---|
| 10,053,859 | B2 | 8/2018 | Evensen et al. | |
| 10,202,762 | B2 | 2/2019 | Sollohub et al. | |
| 10,450,743 | B2 * | 10/2019 | Frederick | E04B 2/90 |
| 10,822,862 | B2 * | 11/2020 | Header | E06B 3/26303 |
| 10,851,581 | B2 | 12/2020 | Benes | |
| 10,900,273 | B1 * | 1/2021 | Salvoni | E06B 3/4636 |
| 2005/0138889 | A1 | 6/2005 | Biebuyck | |
| 2013/0291459 | A1 | 11/2013 | Frey | |
| 2019/0323231 | A1 | 10/2019 | Margalit | |
| 2019/0323241 | A1 | 10/2019 | Margalit | |
| 2019/0383003 | A1 | 12/2019 | Stahl, Jr. | |
| 2020/0157809 | A1 | 5/2020 | Kropac et al. | |
| 2020/0270932 | A1 * | 8/2020 | Header | E06B 1/70 |
| 2024/0229541 | A1 * | 7/2024 | Depew | E06B 1/702 |

* cited by examiner

PRE-GLAZED WINDOW WALL SYSTEM

BACKGROUND

Window walls are window systems commonly used in residential and commercial buildings, e.g., in storefronts and on the façade of high-rise buildings. Window walls typically span between floors of a building, from a top of a bottom floor slab to the underside of an above floor slab. Sill and head receptors are installed using anchors and shims to accurately set the receptors parallel to one another on the same plane and at the proper height. Once the sill and head receptors are properly installed, a series of unitized window panels or pre-glazed units can be received by the sill and head receptors and secured thereto to progressively build the window wall.

It is always desirable to introduce systems and installation methods that reduce costs and ease the installation process for window walls.

SUMMARY OF THE DISCLOSURE

Embodiments disclosed herein include a window wall system that includes a sill receptor secured to an upper surface of a first floor slab, the sill receptor providing a base and an upright member extending from the base, a head receptor secured to a bottom surface of a second floor slab vertically offset from the first floor slab, and a glazing unit providing a sill, a head, and one or more panels extending between the sill and the head. A first hook is defined by the sill and engageable with the upright member, wherein, when the upright member is received by the hook, the glazing unit is pivotable about the upright member toward a vertical orientation, and a second hook is defined by the sill and receivable within a groove defined in the sill receptor when the glazing unit reaches the vertical orientation. In a further embodiment of the window wall system, the upright member extends perpendicular from the base. In another further embodiment, the first hook extends downward and thereby defines a downwardly-opening channel sized to receive the upright member. In another further embodiment, wherein receiving the upright member in the channel prevents the glazing unit from migrating toward an exterior or interior environment. In another further embodiment, the window wall system further comprises a spring clip operable to prevent the head from exiting the head receptor once the head is received within the head receptor and the glazing unit reaches the vertical orientation. In another further embodiment, the spring clip is mounted to the head. In another further embodiment, the spring clip is mounted to the head receptor. In another further embodiment, the spring clip provides a spring-loaded biasing member configured to locate a pocket when the glazing unit reaches the vertical orientation, and wherein the spring-loaded biasing member engages an obstruction within the pocket that prevent the head from exiting the head receptor.

Embodiments disclosed herein may further include a method of installing a glazing unit of a window wall system, the method including the steps of securing a sill receptor to an upper surface of a first floor slab, the sill receptor providing a base and an upright member extending from the base, securing a head receptor secured to a bottom surface of a second floor slab vertically offset from the first floor slab, receiving the glazing unit between the first and second floor slabs, the glazing unit including a sill, a head, and one or more panels extending between the sill and the head, engaging a first hook defined by the sill with the upright member, and pivoting the glazing unit about the upright member and toward a vertical orientation, and receiving a second hook defined by the sill within a groove defined in the sill receptor when the glazing unit reaches the vertical orientation. In a further embodiment, the first hook extends downward and thereby defines a downwardly-opening channel sized to receive the upright member, and wherein engaging the first hoot with the upright member comprises receiving the upright member in the channel and thereby preventing the glazing unit from migrating toward an exterior or interior environment. In another further embodiment, the method further comprises preventing uplift of the glazing unit by receiving the second hook within the groove. In another further embodiment, the method further comprises securing the glazing unit to the sill receptor without mechanical fasteners. In another further embodiment, pivoting the glazing unit toward the vertical orientation further comprises locating a spring-loaded biasing member of a spring clip in a pocket once when the glazing unit reaches the vertical orientation, and engaging the spring-loaded biasing member against an obstruction within the pocket and thereby preventing the head from exiting the head receptor.

Embodiments disclosed herein may also include a window wall system that includes a first glazing unit arranged adjacent a first vertical wall substrate, a second glazing unit arranged adjacent a second vertical wall substrate opposite the first vertical wall substrate, one or more third glazing units extending laterally between the first and second glazing units, and a jamb filler operatively coupled to the second glazing unit and interposing the second glazing unit and the second vertical wall substrate. In a further embodiment, the jamb filler is operatively coupled to the second gazing unit via one or more mating features and without mechanical fasteners. In another further embodiment, the window wall system further comprises one or more backer rods interposing the jamb filler and the second vertical wall substrate. In another further embodiment, one or more third glazing units include a left glazing unit that includes a right vertical mullion half, and a right glazing unit that includes a left vertical mullion half, wherein the left and right glazing units are secured together by mating the right and left vertical mullion halves. In another further embodiment, wherein the right and left vertical mullion halves are mated by shifting the right glazing unit toward the left glazing unit until the left vertical mullion half locates and mates to the right mullion half. In another further embodiment, the right and left vertical mullion halves are mated via a snap-in engagement.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure is related to window wall systems and, more particularly, to window wall systems with glazing units that are vertically pivotable to install. The glazing units can be pre-glazed and installed using a unique sill-to-sill flashing interlocking engagement at the sill, temporary spring clips at the head and a mullion filler at the last bay jamb. After a sill flashing and a head receptor are installed into the rough opening, the glazing units are installed entirely from the interior of the building by tilting the top of the glazing unit inward and into the building, engaging the sill flashing, and tilting (pivoting) the top back to vertical as engaged to the sill flashing. By tilting only in the horizontal plane, the glazing units are installed straight into the opening, thus eliminating any need for tilting units while they are outside of the opening beyond the slab edge. Engagement and retention of the sill in the sill flashing is provided by the profile geometry which uses a primary hook for alignment and a secondary hook for engagement, which eliminate the typical need for sill-to-sill flashing fasteners. Retention at the head can be provided by a spring clip. After tilting (pivoting) each pre-glazed unit upright into the opening, they can be slid sideways to engage the previously installed unit.

Figure 1:
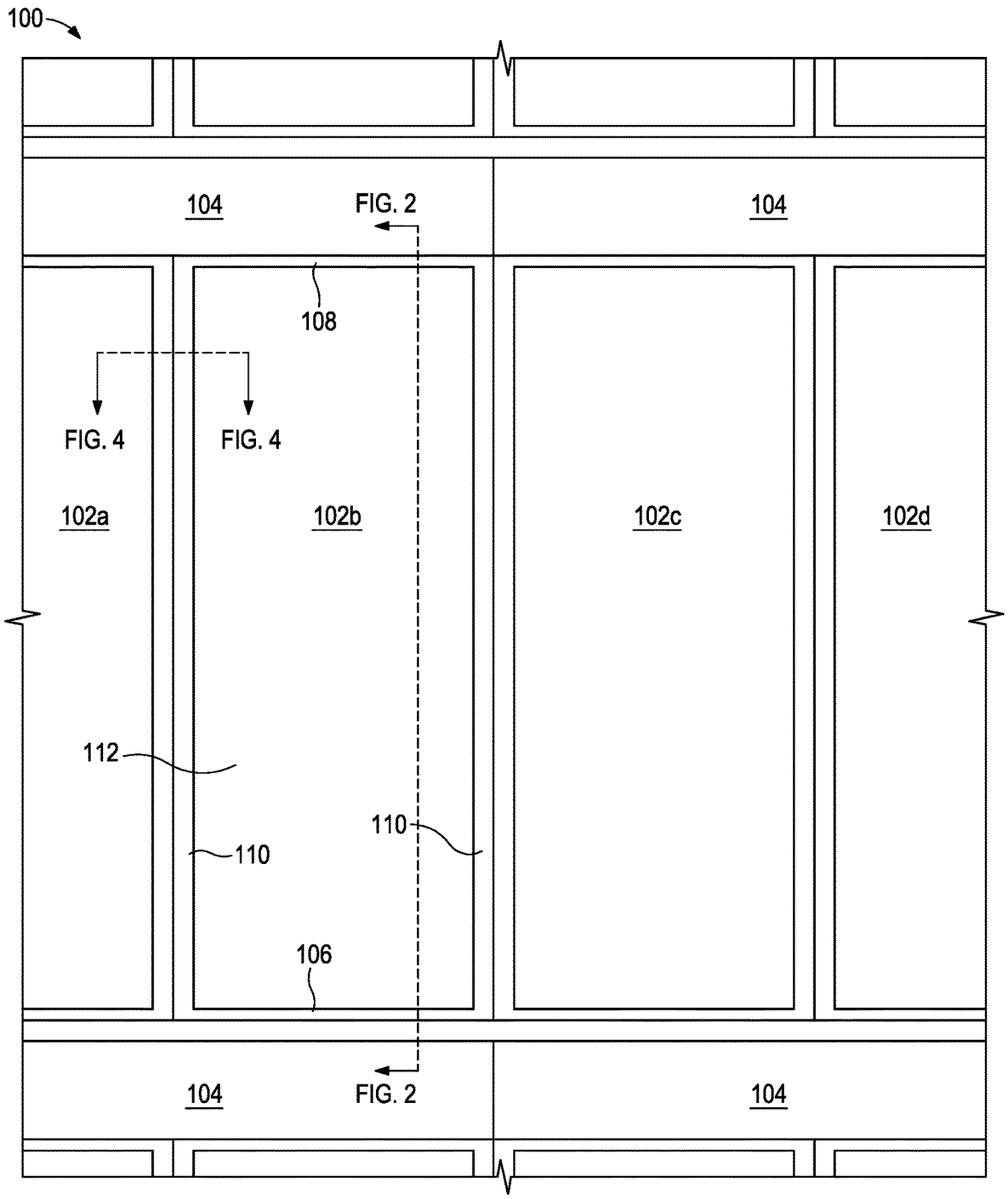
FIG. 1 is a schematic front view of an example window wall system 100 that may incorporate the principles of the present disclosure.

FIG. 1 is a schematic front view of an example window wall system 100 that may incorporate the principles of the present disclosure. The window wall system 100 (hereafter "the system 100") may be suitable for installation in large commercial buildings, such as a skyscrapers, but could alternatively be applied to smaller commercial or residential buildings, without departing from the scope of the disclosure. The system 100 includes an assembly of a plurality of shop-assembled glazing units, shown in FIG. 1 as glazing units 102*a*, 102*b*, 102*c*, and 102*d*. The glazing units 102*a-d* are arranged between upper and lower floor slabs (not visible), which are covered with a decorative slab edge cover 104.

Each glazing unit 102*a-d* may be substantially similar in construction. However, for purposes of discussion, the second glazing unit 102*b* will be described in further detail below, but discussion of the second glazing unit 102*b* is equally applicable to the other glazing units 102*a,c,d*.

As illustrated, the glazing unit 102*b* includes a sill 106, a head 108, and a pair of laterally spaced mullions 110 extending vertically between the sill 106, and the head 108. The sill 106, the head 108, and the vertical mullions 110 may each comprise a rigid extrusion made of aluminum, an aluminum alloy, or other metals and metal alloys. The combination of the sill, 106, the head 108, and the vertical mullions 110 cooperatively encompass and secure a panel 112 on all four sides to form a solid structure. The panel 112 may comprise, for example, a pane of window glass, polycarbonate, or another clear, translucent, tinted, or opaque material.

Figure 2:
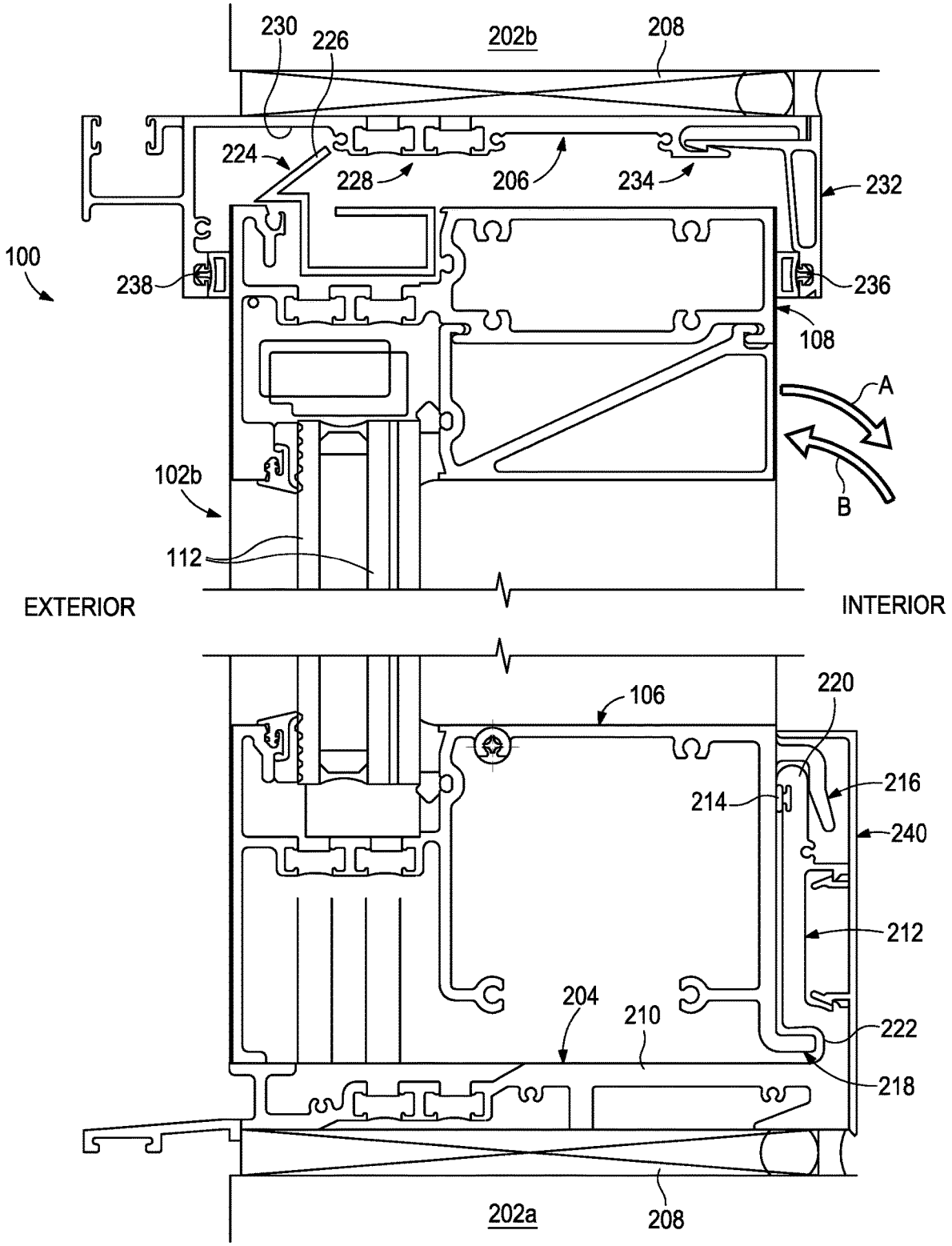
FIG. 2 is cross-sectional side view of a portion of the window wall system of FIG. 1, as taken along the lines 2-2 in FIG. 1, according to one or more embodiments of the present disclosure.

FIG. 2 is cross-sectional side view of a portion of the window wall system 100, as taken along the lines 2-2 in FIG. 1, according to one or more embodiments of the present disclosure. As illustrated, the system 100 may be installed between a first or "lower" floor slab 202*a* and a second or "upper" floor slab 202*b*, where the floor slabs 202*a,b* are vertically spaced from each other and generally parallel to accommodate the system 100. As illustrated, the system 100 includes a sill receptor 204 and a head receptor 206. The sill receptor 204, alternately referred to as a "sill flashing," is secured to the upper surface of the lower floor slab 202*a*, and the head receptor 206 is secured to the bottom surface of the upper floor slab 202*b*.

One or more shims 208 may be inserted between the sill and head receptors 204, 206 and the vertically adjacent lower and upper slabs 202*a,b*, respectively, to adjust the receptors 204, 206 to a proper level. A weather seal caulk may be applied to both the exterior and interior sides of the receptors 204, 206 to seal any gaps between the slabs 202*a,b* and the corresponding receptors 204, 206 from air and water infiltration. Once properly shimmed, the sill and head receptors 204, 206 may be fixed to the lower and upper slabs 202*a,b*, respectively, using one or more mechanical fasteners (not shown).

The system 100 also includes a glazing unit, such as the second glazing unit 102*b* discussed above. The glazing unit 102*b* may be fabricated, assembled and pre-glazed prior to being transported to the site of the system 100, and may be configured to be installed between the sill and head receptors 204, 206. As described above, the glazing unit 102*b* includes the sill 106, the head 108, and one or more panels 112 extending between the sill 106 and the head 108. While not shown in FIG. 2, the glazing unit 102*b* further includes the pair of laterally-spaced vertical mullions 110 (FIG. 1) that also extend between the sill 106 and the head 108.

In the illustrated embodiment, the glazing unit 102*b* includes two panels 112 separated by a gap that may be filled with air, an inert gas, and/or a coating to control transmission of thermal energy by conduction, radiation and convection between the interior of the building and the exterior environment. In other embodiments, however, the glazing unit 102*b* may have more or less than two panels 112, without departing from the scope of the disclosure.

Once the sill and head receptors 204, 206 are properly shimmed and installed, the glazing unit 102*b* may be installed from the interior of the building by tilting the top of the glazing unit 102*b* (e.g., the head 108) toward the interior of the building, as indicated by the arrow A, and receiving the sill 106 at the sill receptor 204. As illustrated, the sill receptor 204 provides or otherwise defines a base 210 and an upright member 212 (alternately referred to as an "upturned leg") that extends from the base 210. When the sill receptor 204 is installed on the lower slab 202*b*, the base 210 lies substantially horizontal, and the upright member 212 extends substantially vertical from the base 210. In some embodiments, the upright member 212 may extend perpendicular (e.g., 90°) or close to perpendicular from the base 210, but may alternatively extend vertically from the base 210 at an angle greater or less than 90°, without departing from the scope of the disclosure.

In at least one embodiment, as illustrated, a gasket 214 may interpose the upright member 212 and a portion of the sill 106 to generate a sealed interface at that location. In some embodiments, the gasket 214 may be carried by the upright member 212, but may alternatively be carried by the sill 106. In yet other embodiments, the gasket 214 may be independent of either of the upright member 212 or the sill 106, and in such embodiments the gasket 214 may simply provide a sealed interface between the upright member 212 and the sill 106.

The sill 106 may provide or otherwise define a first or "primary" hook 216 and a second or "secondary" hook 218.

The primary hook 216 may be configured to mate with the upright member 212 as the sill 106 is brought into engagement with the sill receptor 204. More specifically, the primary hook 216 extends downward and thereby defines a downwardly-opening channel sized to receive an upper end 220 of the upright member 212. Once the upright member 212 is received within the primary hook 216, the glazing unit 102*b* may be able to pivot on the upright member 212, and the top of the glazing unit 102*b* (e.g., the head 108) may be tilted back toward the exterior of the building, as indicated by the arrow B. As the glazing unit 102*b* tilts toward the exterior in the direction B, the secondary hook 218 may be received within a groove 222 defined in the sill receptor 204. In some embodiments, as illustrated, the groove 222 may extend substantially parallel to the base 210.

The primary and secondary hooks 216, 218 may prove advantageous in securing the glazing unit 102*b* to the sill receptor 204 without the use of mechanical fasteners (e.g., conventional sill-to-sill flashing fasteners). More specifically, the primary hook 216 facilitates pivoting of the glazing unit 102*b* to a vertical position, but also serves as a safety feature that prevents the glazing unit 102*b* from migrating (slipping) toward the exterior of the building during installation and provides resistance to positive and negative design wind loads after installation. Moreover, the secondary hook 218 received within the groove 222 may prove advantageous in preventing uplift (e.g., moving vertically upward) of the glazing unit 102*b* during heavy wind loads. Consequently, receiving the secondary hook 218 within the groove 222 obviates the need for using a mechanical fastener to prevent uplift.

As the glazing unit 102*b* tilts toward the exterior in the direction B, the head 108 is eventually received by the head receptor 206. In some embodiments, the glazing unit 102*b* may further include a spring clip 224 mounted to or otherwise received by the head 108. The spring clip 224 may provide or define a spring-loaded biasing member 226. As the head 108 is received at the head receptor 206 moving in the direction B, the biasing member 226 may engage and ratchet against various internal features 228 of the head receptor 206. Once the glazing unit 102*b* reaches a substantially vertical orientation, however, the biasing member 226 may locate or otherwise be received into a channel or pocket 230 defined by the head receptor 206. As it enters the pocket 230, the biasing member 226 may naturally spring outward and thereby lock the head 108 in place with the head receptor 206. With the biasing member 226 biased (extended) outward, the head 108 is unable to reverse course in the direction A, thus securing the glazing unit 102*b* in its vertical orientation.

As will be appreciated, the spring clip 224 could alternatively be mounted to the head receptor 206, without departing from the scope of the disclosure. In such embodiments, the biasing member 226 may instead interact with features of the head 108 to prevent the glazing unit 102*b* from departing from its vertical orientation. Once the glazing unit 102*b* is oriented substantially vertical it can be shifted laterally to engage a previously installed glazing unit (not shown).

Once the glazing unit 102*b* is oriented substantially vertical, a head receptor face plate 232 may be secured to the head receptor 206 to fully secure the glazing unit 102*b* within the system 100. In at least one embodiment, as illustrated, the head receptor face plate 232 may be configured for a snap-in engagement to the head receptor 206. In such embodiments, for example, the head receptor 206 and the head receptor face plate 232 may provide opposing hook features 234 that interlock to secure the head receptor face plate 232 to the head receptor 206.

Moreover, in such embodiments, a gasket 236 may be arranged at the interface between the head receptor face plate 232 and the head 108. The gasket 236 may be arranged in the interior of the building and, as illustrated, may be carried on the head receptor face plate 232, but could alternatively be carried on the head 108 or may otherwise be independent of either structure. Another gasket 238 may be arranged at the interface between the head receptor 206 and the head 108. The gasket 238 may be arranged at the exterior of the building and, as illustrated, may be carried on the head receptor 206, but could alternatively be carried on the head 108 or may otherwise be independent of either structure.

In some embodiments, the system 100 may further include an interior sill cover 240 that is mounted to one or both of the sill receptor 204 and the sill 106. In the illustrated embodiment, the interior sill cover 240 may provide a snap-in engagement with one or more corresponding features on one or both of the sill receptor 204 and the sill 106. The interior sill cover 240 may provide an aesthetic feature that conceals the primary hook 216 and the upright member 212.

The glazing unit 102*b* may be installed entirely from the interior of the building by first tilting the top of the glazing unit 102*b* toward the interior, in the direction A, and then tilting back to vertical in the direction B, as generally described above. This is in contrast to conventional window wall installation, which typically requires glazing units to be installed from the exterior of the building and/or angling the glazing unit about a vertical axis. Moreover, the interlocking sill 104 and the sill receptor 204, combined with the spring clip 224 at the head 108, may prove advantageous in allowing for quick and easy installation of pre-glazed units without the need for mechanical fasteners.

Figure 3:
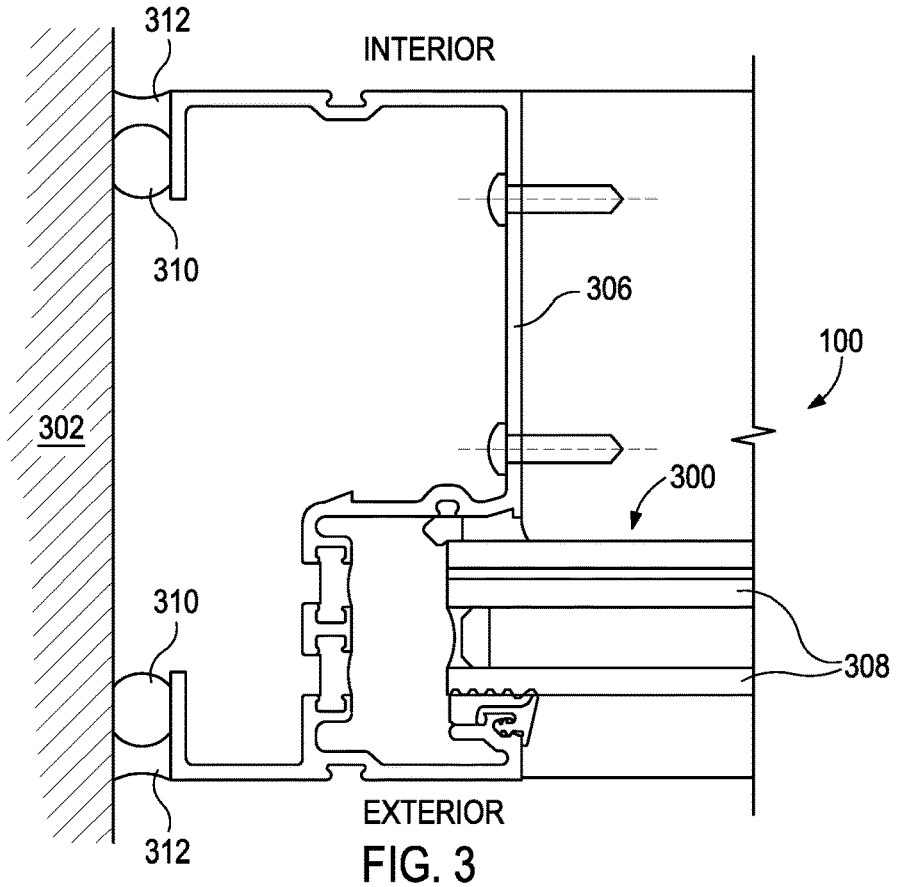
FIG. 3 is a cross-sectional top view of a portion of the system of FIG. 1, according to one or more embodiments.

FIG. 3 is a cross-sectional top view of a portion of the system 100 of FIG. 1, according to one or more embodiments. In the illustrated embodiment, a glazing unit 300, similar in some respects to the glazing unit 102*b* of FIG. 2, may be arranged adjacent a vertical wall substrate 302. The system 100 may be constructed starting from the vertical wall substrate 302 and progressively installed toward the right in FIG. 3. Accordingly, the vertical wall substrate 302 may be referred to as the "left" vertical wall substrate 302. And because it is to be positioned adjacent the left vertical wall substrate 302, the glazing unit 300 may be referred to as the "first bay" glazing unit and all subsequent glazing units will be progressively added to the right in FIG. 3 by laterally abutting up against the previously installed glazing unit.

In alternative embodiments, the vertical wall substrate 302 may be a "right" vertical wall substrate 302, and the all subsequent glazing units installed after the glazing unit 300 will be progressively added to the left by laterally abutting up against the previously installed glazing unit.

As illustrated, the first bay glazing unit 300 may include a vertical jamb member or "mullion" 306 and one or more panels 308 (two shown) are received by and extend from the vertical jamb member 306. The panels 308 may be similar to the panels 112 of FIGS. 1 and 2. In contrast to subsequently installed glazing units, which will include left and right vertical mullion halves, the first bay glazing unit 300 includes the vertical jamb member 306 configured for abutting up against the vertical wall substrate 302. In some embodiments, one or more backer rods 310 may interpose the vertical jamb member 306 and the adjacent outer surface of the vertical wall substrate 302. Once the first bay glazing unit 300 is properly positioned, a perimeter sealant 312 may be applied at the gap between the first bay glazing unit 300 and the vertical wall substrate 302 to seal the interface. The vertical backer rods 310 provide a backup surface that prevents the sealant 312 from being deposited into the open interior of the jamb mullion 306.

Figure 4:
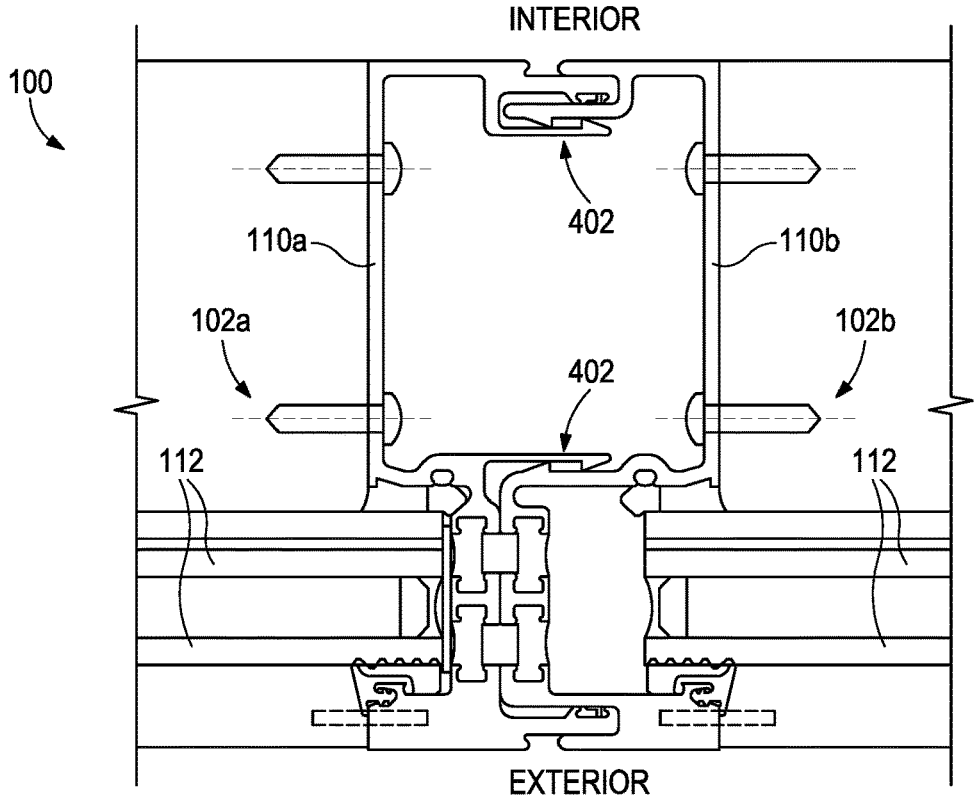
FIG. 4 is a cross-sectional top view of another portion of the system of FIG. 1, according to one or more additional embodiments.

FIG. 4 is a cross-sectional top view of a portion of the window wall system 100, as taken along the lines 4-4 in FIG. 1, according to one or more embodiments of the present disclosure. In the illustrated embodiment, the first and second glazing units 102*a* and 102*b* are arranged side-by-side and otherwise laterally adjacent one another.

As illustrated, each glazing unit 102*a,b* includes a vertical mullion half, shown as mullions 110*a* and 110*b*, and one or more panels 112 (two shown in each) are received by and extend from each vertical mullion 110*a,b*. The vertical mullion half 110*a* for the first glazing unit 102*a* can be referred to as a "right" vertical mullion half 110*a*, and the vertical mullion half 110*b* for the second glazing unit 102*b* can be referred to as a "left" vertical mullion half 110*b*. In some embodiments, the mullion halves 110*a,b* may alternatively be referred to as "split" mullions since they are designed to interconnect with a laterally adjacent "split" mullion to form a combined vertical mullion.

The first glazing unit 102*a* may be installed in the system 100, as generally described herein with reference to installation of the glazing unit 102*b* of FIG. 2. Once the first glazing unit 102*a* is properly installed, the second glazing unit 102*b* may be subsequently installed in the same manner and moved (shifted, slid, etc.) laterally into engagement with the first glazing unit 102*a*, as shown in FIG. 4.

As the second glazing unit 102*b* is moved into lateral engagement with the first glazing unit 102*a* (e.g., to the left in FIG. 4), the left and right mullion halves 110*a,b* may be mated together, thus securing the first glazing unit 102*a* to the second glazing unit 102*b*. In some embodiments, for example, the left and right mullion halves 110*a,b* may provide or otherwise define one or more opposing hook features 402 (two shown) configured to mate and interlock to secure the second glazing unit 102*b* to the first glazing unit 102*a*. The hook features 402 may comprise, for example, a snap-in or snap-fit engagement between the left and right mullion halves 110*a,b*.

The two mullion halves 110*a,b* may be designed to provide a positive stop when pushed together laterally without obstructing the continuity of the thermal breaks. Those skilled in the art will readily appreciate that such a feature helps ensure quality control and can be a time saver for an installer. In contrast, when installing conventional glazing units, an installer would typically push the two units together and attempt to stop when the mullion width is at a specific, predetermined dimension.

Figure 5:
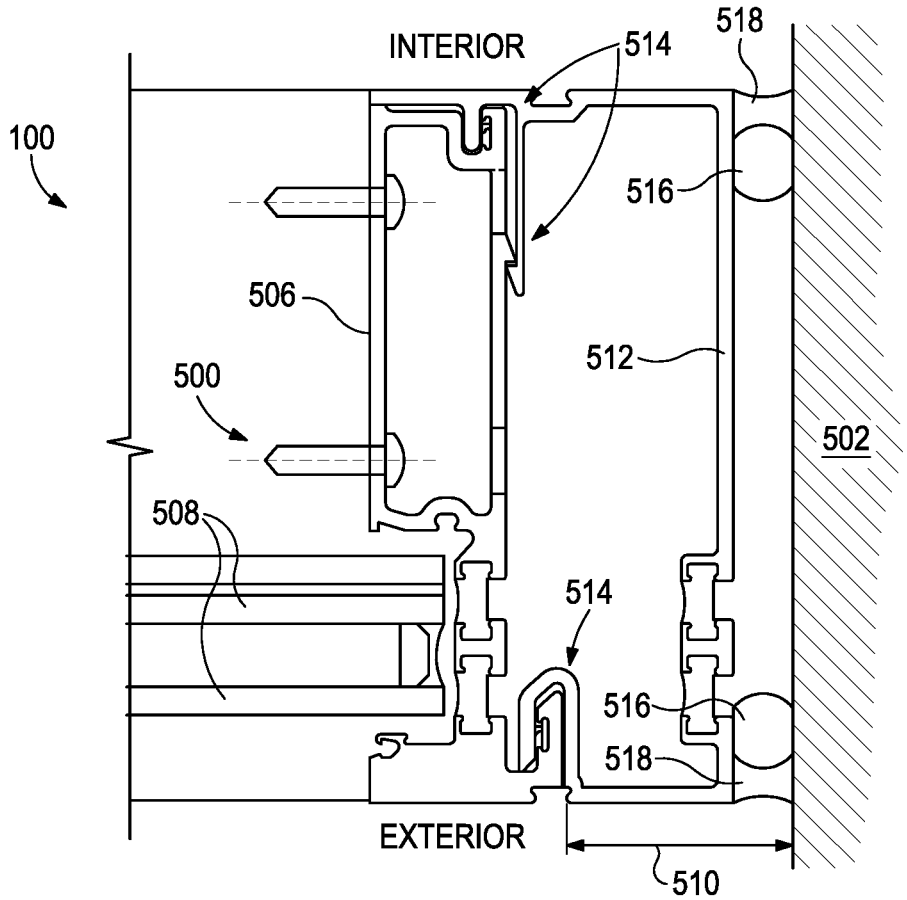
FIG. 5 is a cross-sectional top view of another portion of the system of FIG. 1, according to one or more additional embodiments.

FIG. 5 is a cross-sectional top view of another portion of the system 100 of FIG. 1, according to one or more additional embodiments. In the illustrated embodiment, a glazing unit 500 similar in some respects to the glazing unit 102*b* of FIG. 2 may be arranged adjacent a vertical wall substrate 502. Installation of the system 100 may terminate at the vertical wall substrate 502. Accordingly, the vertical wall substrate 502 may be referred to as the "right" vertical wall substrate 502, and because it is positioned adjacent the right vertical wall substrate 502, the glazing unit 500 may be referred to as the "last bay" glazing unit in the system 100.

In alternative embodiments, the vertical wall substrate 502 may be a "left" vertical wall substrate 502, and the glazing units may be installed progressively toward the left until reaching the vertical wall substrate 502 where the last bay glazing unit 500 is installed.

As illustrated, the glazing unit 500 may include a vertical jamb member or "mullion" 506 and one or more panels 508 (two shown) are received by and extend from the vertical jamb member 506. The panels 508 may be similar to the panels 112 of FIGS. 1 and 2, and the vertical jamb member 506 may be similar to the vertical jamb member 306 of FIG. 3, except that the vertical jamb member 506 is configured for placement laterally adjacent the right vertical wall substrate 502.

Upon installing and mating the last glazing unit 500 with the penultimate glazing unit (not shown) in the system 100, a gap 510 may remain between the last glazing unit 500 (e.g., the vertical jamb member 506) and the right vertical wall substrate 502. In some embodiments, the system 100 may further include a jamb filler 512 configured to be installed in the system 100 to interpose the last glazing unit 500 and the right vertical wall substrate 502 and thereby fill (extend across) the gap 510. The jamb filler 512 may be secured and otherwise mated to the glazing unit 500 via one or more mating features 514, such as opposing hook members or the like. Accordingly, the jamb filler 512 may be secured to the glazing unit 500 without the need for mechanical fasteners, but may instead be secured via a snap-in or snap-fit engagement, or the like.

In some embodiments, one or more backer rods 516 may interpose the jamb filler 512 and the adjacent outer surface of the right vertical wall substrate 502. Once the glazing unit 500 and the jamb filler 512 are properly positioned, a sealant 518 may then be applied at the gap between the jamb filler 512 and the vertical wall substrate 502 to seal the interface. The vertical backer rods 516 provide a backup surface that prevents the sealant 518 from being deposited into the open interior of the jamb filler 512.

Those skilled in the art will readily appreciate the advantages of the jamb filler 512, which eliminates the need for extra wide jamb shim joints common to conventional window wall systems. Use of the jamb filler 512 is possible since the glazing panels of the system 100 are designed to be installed straight into the opening by tilting the top of the glazing panel toward the interior. In contrast, in conventional window wall systems, the last glazing panel is commonly installed by installing from the outside or pivoting about a vertical axis. In some applications, using the jamb filler 512 may allow the gap between the jamb filler 512 and the right vertical wall substrate 502 to decrease to about ½ inch.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

The use of directional terms such as above, below, upper, lower, upward, downward, left, right, and the like are used in relation to the illustrative embodiments as they are depicted in the figures, the upward direction being toward the top of the corresponding figure and the downward direction being toward the bottom of the corresponding figure.

What is claimed is:

1. A window wall system, comprising:

a sill receptor secured to an upper surface of a first floor slab, the sill receptor providing a base and an upright member extending from the base;

a head receptor secured to a bottom surface of a second floor slab vertically offset from the first floor slab;

a glazing unit providing a sill, a head, and one or more panels extending between the sill and the head;

a first hook defined by the sill and engageable with the upright member, wherein the first hook extends downward and thereby defines a downwardly-opening channel sized to receive the upright member such that the glazing unit is pivotable about the upright member toward a vertical orientation; and a second hook defined by the sill and receivable within a groove defined by the upright member in the sill receptor when the glazing unit reaches the vertical orientation, wherein the groove extends substantially parallel to the base.

2. The window wall system of claim 1, wherein the upright member extends perpendicular from the base.

3. The window wall system of claim 1, wherein receiving the upright member in the channel prevents the glazing unit from migrating toward an exterior or interior environment.

4. The window wall system of claim 1, further comprising a spring clip operable to prevent the head from exiting the head receptor once the head is received within the head receptor and the glazing unit reaches the vertical orientation.

5. The window wall system of claim 4, wherein the spring clip is mounted to the head.

6. The window wall system of claim 4, wherein the spring clip is mounted to the head receptor.

7. The window wall system of claim 4, wherein the spring clip provides a spring-loaded biasing member configured to locate a pocket when the glazing unit reaches the vertical orientation, and wherein the spring-loaded biasing member engages an obstruction within the pocket that prevent the head from exiting the head receptor.

8. A method of installing a glazing unit of a window wall system, comprising:

securing a sill receptor to an upper surface of a first floor slab, the sill receptor providing a base and an upright member extending from the base;

securing a head receptor secured to a bottom surface of a second floor slab vertically offset from the first floor slab;

receiving the glazing unit between the first and second floor slabs, the glazing unit including a sill, a head, and one or more panels extending between the sill and the head;

receiving the upright member within a downwardly-opening channel defined by a first hook defined by the sill and pivoting the glazing unit about the upright member and toward a vertical orientation; and receiving a second hook defined by the sill within a groove defined by the upright member in the sill receptor when the glazing unit reaches the vertical orientation, wherein the groove extends substantially parallel to the base.

9. The method of claim 8, wherein receiving the upright member within a downwardly-opening channel comprises:

receiving the upright member in the channel and thereby preventing the glazing unit from migrating toward an exterior or interior environment.

10. The method of claim 8, further comprising preventing uplift of the glazing unit by receiving the second hook within the groove.

11. The method of claim 8, further comprising securing the glazing unit to the sill receptor without mechanical fasteners.

12. The method of claim 8, wherein pivoting the glazing unit toward the vertical orientation further comprises:

locating a spring-loaded biasing member of a spring clip in a pocket once when the glazing unit reaches the vertical orientation; and engaging the spring-loaded biasing member against an obstruction within the pocket and thereby preventing the head from exiting the head receptor.

13. A window wall system, comprising:

a sill receptor secured to an upper surface of a first floor slab, the sill receptor providing a base and an upright member extending from the base;

a glazing unit providing a sill;

a first hook defined by the sill, wherein the first hook extends downward and thereby defines a downwardly-opening channel sized to receive the upright member; and a second hook defined by the sill and receivable within a groove defined by the upright member in the sill receptor, wherein the groove extends substantially parallel to the base.

14. The window wall system of claim 13, wherein the glazing unit further provides a head, and wherein the window wall system further comprises:

a head receptor secured to a bottom surface of a second floor slab vertically offset from the first floor slab; and a spring clip operable to prevent the head from exiting the head receptor once the head is received within the head receptor.

15. The window wall system of claim 14, wherein the spring clip is mounted to the head.

16. The window wall system of claim 14, wherein the spring clip is mounted to the head receptor.

* * * * *